United States Patent [19]

Soes

[11] 4,019,800

[45] Apr. 26, 1977

[54] UNIPLANAR ELECTRICAL CONTACT

[75] Inventor: Lucas Soes, Vught, Netherlands

[73] Assignee: AMP Incorporated, Harrisburg, Pa.

[22] Filed: May 7, 1976

[21] Appl. No.: 684,336

[30] Foreign Application Priority Data

May 31, 1975 United Kingdom ..... 23731/75

[52] U.S. Cl. ..... 339/97 R

[51] Int. Cl.[2] ..... H01R 9/08

[58] Field of Search ..... 339/97–99

[56] References Cited

UNITED STATES PATENTS

| | | | |
|---|---|---|---|
| 3,845,455 | 10/1974 | Shoemaker | 339/97 R |
| 3,955,873 | 5/1976 | Peterson | 339/99 R |

FOREIGN PATENTS OR APPLICATIONS

| | | | |
|---|---|---|---|
| 2,254,318 | 5/1974 | Germany | 339/97 R |

*Primary Examiner*—Joseph H. McGlynn
*Attorney, Agent, or Firm*—Allan B. Osborne

[57] ABSTRACT

A uniplanar electrical contact has a pair of axially aligned intercommunicating slots of different widths. An insulating conductor is folded so that portions overlap, one portion extending into the slot of narrower width so that the edges of the slot pierce the insulation and electrically engage the conductor and the other portion extending into the wider slot so that the edges of the arms defining the wider slot pierce the insulation to provide a strain relief effect but do not engage the conductor.

3 Claims, 4 Drawing Figures

UNIPLANAR ELECTRICAL CONTACT

The present invention relates to electrical connections and in particular, electrical connections between insulated conductors and electrical contacts.

According to the present invention, in an electrical connection between an insulated conductor and an electrical contact, the electrical contact is in the form of a uniplanar member including a pair of spaced arms, opposed edges of which arms define between them a pair of intercommunicating slots of different widths, the insulated conductor being folded so that portions overlap, one portion extending into the slot of narrower width so that the edges of the arms defining the narrower slot pierce the insulation and electrically engage the conductor, and the other portion extending into the wider slot so that the edges of the arms defining the wider slot pierce the insulation to provide a strain relief effect.

The insulated conductor may be a single solid or stranded conductor embedded in the insulating material or a round or flat conductor being one of a plurality of such conductors embedded in insulating material to form a ribbon like or flat flexible cable.

Embodiments of the invention will now be described, by way of example, reference being made to the Figures of the accompanying diagrammatic drawings in which.

Figure 1:
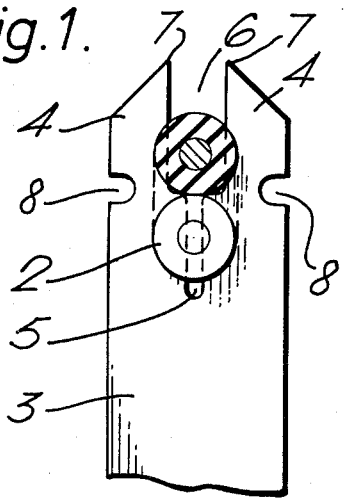
FIG. 1 is a front elevation of an electrical connection.
Figure 2:
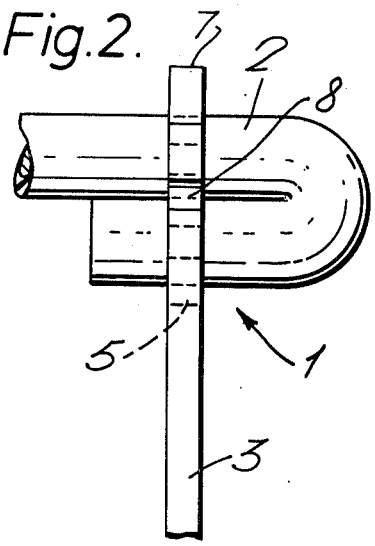
FIG. 2 is a side elevation of the electrical connection of FIG. 1.

As shown in FIGS. 1 and 2, an electrical connection 1 includes an insulated conductor 2 and an electrical contact 3.

The electrical contact 3 is in the form of an elongate, stamped uniplanar member of electrically conductive material. The member includes a pair of spaced arms 4 having opposed edges which define between them a pair of axially aligned intercommunicating slots 5, 6 of different widths. The free ends of the arms 4 are chamfered to provide sharp cutting edges 7. A notch 8 is formed in each side edge of the member in general alignment with the base or root of the wider slot 6.

The insulated conductor 2 is a round, solid conductor surrounded by insulating material. In other words, the insulated conductor is a wire having a solid central conductor surrounded by insulating material. The conductor 2 is folded at one end so that portions overlap. The portions are forced into respective slots 5, 6, the lower portion, as shown, being forced into the narrower slot 5 so that the edges of the arms 4 defining the slot 5 pierce the insulation and electrically engage the central conductor and the upper portion, as shown, is forced into the wider slot 6 so that the edges of the arms 4 defining the slot 6 pierce the insulation but do not engage the central conductor. The edges 7 assist in the piercing of the insulation.

If the conductor 2 of the electrical connection 1 is subjected to an axial pull then the force of the pull will be resisted by the edges of the arms 4 defining the slot 6. In effect, they provide a strain relief effect on the insulation of the conductor 2. The strain relief effect on the edges defining the slot 6 will minimize the transference of the force to the edges of the slot 5 which electrically contact the central conductor.

An advantage of the electrical connection described above is, that the electrical engagement of the conductor and the strain relief effect and insulation support are provided in a single uniplanar member which reduces costs and provides a simple and effective means for making an electrical connection.

If necessary, the slot 6 can be closed slightly by bending each arm 4 about the location between a notch 8 and the root of the slot 6.

Figure 3:
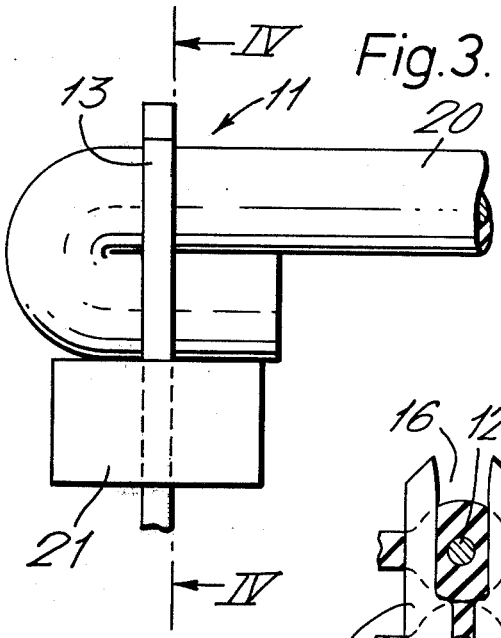
FIG. 3 is a side elevation of a further electrical connection.
Figure 4:
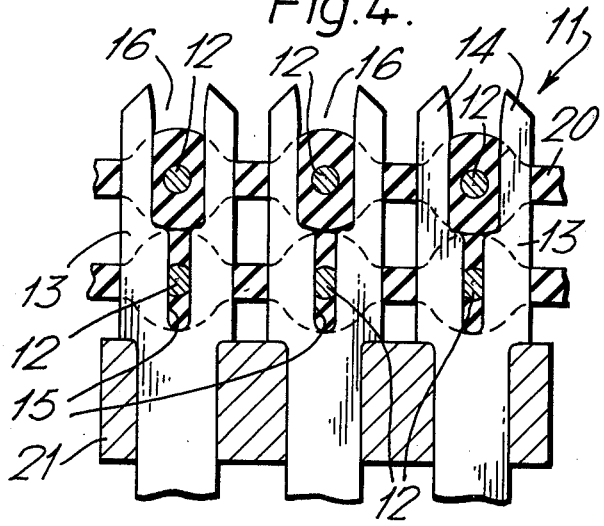
FIG. 4 is a cross-section on the line 4—4 of FIG. 3.

As shown in FIGS. 3 and 4, an electrical connection 11 includes a plurality of conductors 12 forming part of a ribbon cable 20, the conductors being surrounded with insulating material. Each conductor 12 is assembled to an electrical contact 13 similar in most respects to the electrical contact 3 previously described. The electrical contacts 13 are anchored in a support board 21 and includes a pair of arms 14 having opposed edges which define between them a pair of axially aligned intercommunicating slots 15, 16 of different widths. The slots of adjacent contacts 13 are substantially the same pitch distance apart as adjacent conductors 12 of the ribbon cable 20.

The ribbon cable 20 is folded at one end so that portions overlap. The lower portion, as shown, is forced into the narrower slots 15 so that the edges of the arms 14 defining the slots 15 pierce the insulation and electrically engage a conductor 12. The upper portion, as shown, is forced into the wider slots 16 so that the edges of the arms 14 defining the slots 16 pierce the insulation but do not engage a conductor.

In a modification, the conductors could be flat, that is, have a rectangular transverse cross-section.

With both electrical connections described above, it is possible to make the connection of a plurality of electrical contacts with respective conductors substantially simultaneously by gang insertion techniques. Since the contacts are uniplanar they are extremely inexpensive to manufacture which together with the feature of their ability for gang assembly makes the manufacture of a plurality of such connections exceedingly economic. The connection can be made in almost every instance by driving home the folded conductor by pushing on the top portion of the folded part so that the portions are inserted into their respective slots.

What is claimed is:

1. An electrical connection between an insulated conductor and an electrical contact, the electrical contact being in the form of a uniplanar member including a pair of spaced arms, opposed edges of which arms define between them a pair of intercommunicating slots of different widths, the insulated conductor being folded so that portions overlap, one portion extending into the slot of narrower width so that the edges of the arms defining the narrower slot pierce the insulation and electrically engage the conductor, and the other portion extending into the wider slot so that edges of the arms defining the wider slot pierce the insulation to provide a strain relief effect.

2. An electrical connection as claimed in claim 1, in which the conductor is of circular transverse cross-section and is embedded in the insulating material.

3. An electrical connection as claimed in claim 1, in which the conductor is substantially flat and is one of a plurality of identical conductors embedded in insulating material to form a flat flexible cable.

* * * * *